United States Patent [19]

Windish

[11] Patent Number: 4,907,823

[45] Date of Patent: Mar. 13, 1990

[54] LOTTERY KIT

[76] Inventor: Denise M. Windish, 376 LaBore Rd., No. 109, Little Canada, Minn. 55117

[21] Appl. No.: 298,059

[22] Filed: Jan. 17, 1989

[51] Int. Cl.[4] ..... B42D 3/00

[52] U.S. Cl. ..... 281/31; 283/903; 281/29; 281/39; 281/41

[58] Field of Search ..... 283/903; 281/39, 41, 281/29, 31; 206/39, 39.1; 150/147

[56] References Cited

U.S. PATENT DOCUMENTS 2,490,141 12/1949 Lotterer ..... 281/30

4,586,906 5/1986 Buccieri, Jr. ..... 273/148 R 4,630,843 12/1986 Willat ..... 281/30

4,778,153 10/1988 Bachman et al. ..... 283/101

*Primary Examiner*—Douglas D. Watts

*Assistant Examiner*—Thomas Hamill, Jr.

*Attorney, Agent, or Firm*—Jacobson and Johnson

[57] ABSTRACT

A lottery kit comprising a scraping tool for removing particle covering materials from a lottery ticket, a collection mat for collecting the particles, and pocket size foldable panels that contain slash type pockets for frictionally holding a lottery ticket, a scraping tool, and a collection mat.

9 Claims, 2 Drawing Sheets

LOTTERY KIT

FIELD OF THE INVENTION

This invention relates generally to lottery kits and, more specifically, to a lottery kit that can be carried in the user's pocket or purse and includes tools to permit the user to scrape off the covering material on a lottery ticket without getting the scrapings on the user's clothes.

BACKGROUND OF THE INVENTION

Generally, when a user purchases a lottery ticket the user has to hold onto the ticket until the drawing or in some instance the user must scratch covering material off the lottery ticket with a coin or fingernail to reveal a number hidden below the covering material. The present invention recognizes the problem of providing a kit to hold the ticket until the drawing as well as a tool and mat that prevents the scrapings from the covering material from getting on the user's clothing as the covering material is scraped off the lottery ticket.

DESCRIPTION OF THE PRIOR ART

The U.S. Pat. No. 4,778,153 shows a promotional article made from a single sheet of material and having distinct sections that can include tear away portions or "scratch off" sections applied to the sheet through the use of pressure sensitive adhesives.

The U.S. Pat. No. 4,630,843 shows a binder for holding items such as notes, price lists, and other written material in a releasable retaining member between the front and second panels of the binder. A slit in the panel is included to hold a pencil.

The U.S. Pat. No. 4,586,906 shows a lottery marking guide that enables a user to precisely fill in small rectangular areas on a card that is inserted into a machine that prints the lottery ticket.

The U.S. Pat. No. 2,490,141 shows a sales person's folder that has a pencil holder that includes a coil spring and a plate that prevents the pencil point from digging into the folder.

BRIEF SUMMARY OF THE INVENTION

Briefly, the present invention comprises a pocket size lottery kit that includes a tool for scratching off lottery ticket covering materials, a mat for collecting the scrapings, and pockets for conveniently holding the lottery ticket, the tool, and the mat for collecting the scrapings from the lottery ticket.

DESCRIPTION OF THE PREFERRED EMBODIMIENT

Figure 1:
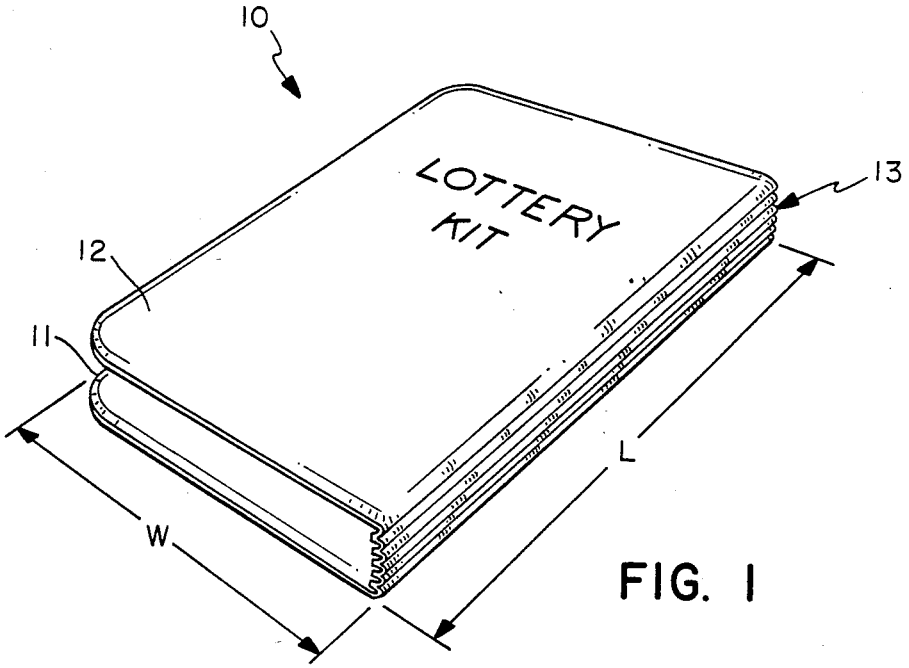
FIG. 1 is a perspective view of the lottery kit in a closed position.

Referring to FIG. 1 reference numeral 10 identifies the lottery kit of my invention comprising a first panel 11, a second panel 12 and a foldable spine 13 that foldable connects first panel 11 to second panel 12 along the sides of the panels. The length of the lottery kit is designated by L and the width is designated by W. The folded dimensions of the lottery kit are such that the lottery kit can be placeed in the user's pocket or purse. I have found that a dimension L of about four inches and a width W of about three inches provides a compact lottery kit that can be placed in a shirt pocket or in a user's purse.

Figure 2:
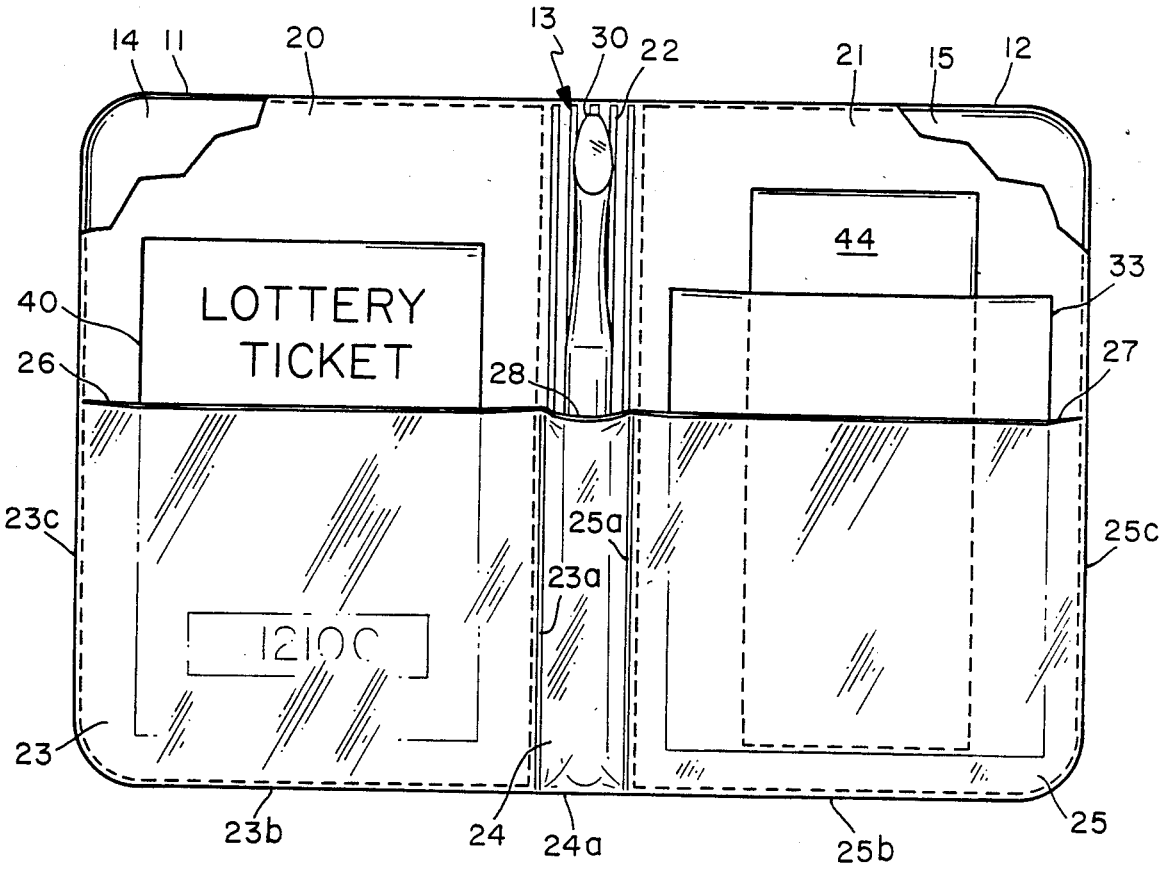
FIG. 2 is a plan view of the lottery kit in the open and unfolded condition.

FIG. 2 shows my lottery kit 10 in the open position and in a partial cutaway view to reveal the panel stiffeners 14 and 15 that are sandwiched respectively between the first panel 11 and inside panel 20 and the second panel 12 and the inside panel 21. Panels 11, 12, 20, and 21 are preferably made of a material such as a vinyl polymer plastic that has a solid color or some other decorative appearance. The first panel 11 and the inside panel 20 are heat sealed to each other around the peripheral edges of the panels to securely hold the stiffener 14 in position. Similarly, the second panel 12 and inside panel 21 are heat sealed to each other around the peripheral edges of the panels to provide a pocket that securely holds stiffener 15 in place. The stiffeners provide protection against the panels on the kit folding in the user's pocket while the outer panels provides a flexible covering with a decorative appearance.

Located between and connecting the first panels to the second panels is a spine 13 that has a series of longitudinal ridges and grooves 32 to facilitate the use of the spine as a continuous foldable hinge to permit the second panel and the first panels to be folded open or folded closed.

Located on panel 20 is a sheet of a clear polymer plastic that is heat sealed to panel 20 along peripheral edges 23*a*, 23*b*, and 23*c* to provide a pocket 26 for receiving a lottery ticket 40. Similarly, located along inside panel 21 is a sheet of clear polymer plastic 25 that is heat sealed to panel 21 along peripheral edges 25*a*, 25*b*, and 25*c to* form a pocket 27 to hold a scrapping collection mat 33. Pockets 26 and 27 provide large flat pockets to hold flat items therein through the friction produced by the pockets contacting opposite sides of the items inserted in the pockets.

A spine pocket 28 for holding a scraping tool 30 is formed by a smaller rectangular sheet of flexible polymer plastic 24 that is heat sealed to lottery kit 10 along edges 24*a*, 25*a*, and 23*a*. The coaction of the groves and ridges 32 along spine 13 and sheet 24 provide a resilient means in pocket 28 for tool 30. The resilient means provides a restraining force on tool 30 even tho one may open or close lottery kit 10. That is, the closing of kit 10 causes the grooves and ridges 32 to expand and stretch thereby providing a resilient force that compensates for the sheet 24 being folded inward as the lottery kit is closed thus insuring that scraping tool 30 is securely held in the lottery kit whether the lottery kit is opened or closed.

Figure 3:
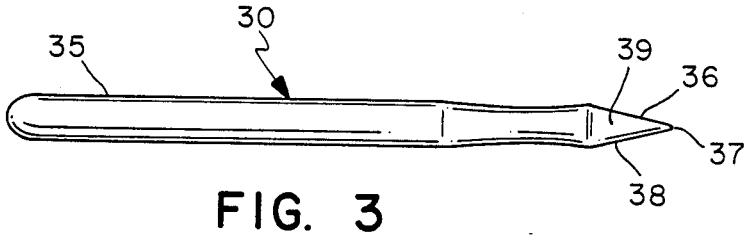
FIG. 3 is a side view of the lottery ticket scraping tool.
Figure 4:
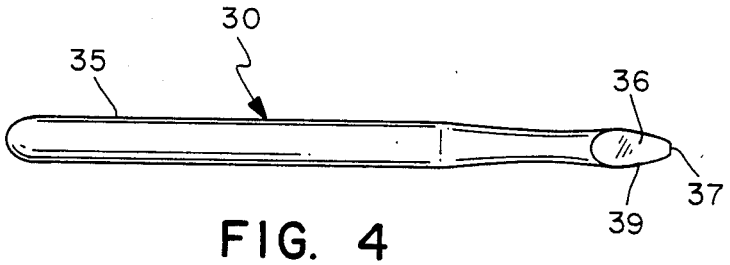
FIG. 4 is a front view of the lottery ticket scraping tool of FIG. 3.
Figure 5:
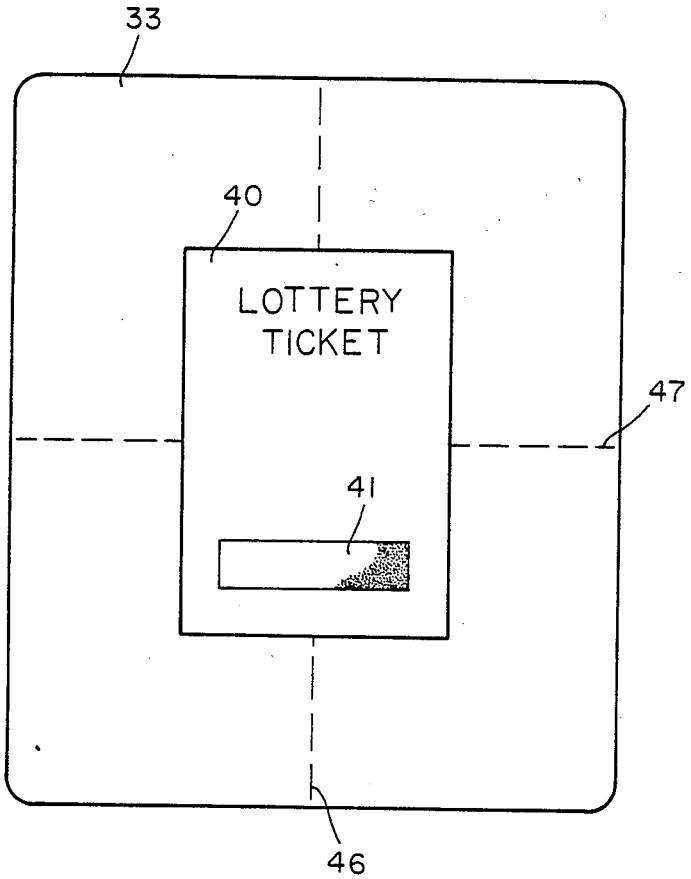
FIG. 5 is a plan view of the lottery ticket collection mat for collecting scrapings from the lottery ticket.

Referring to FIG. 3. and FIG. 4 reference numeral 30 identifies my scraping tool having a cylindrical shaped handle 35 with a scraping head 39 having an oval shaped flat surface 36 that adjoins with another oval shaped flat surface 38 to form a straight blade 37. Scraping tool 30 is made from a rigid polymer plastic material to provide a scraping blade 37 to permit the user to scrape the opaque removable covering material from a lottery ticket with blade 37. Typically, the opaque covering materials on lottery tickets are made from particles that can be scraped off the lottery ticket with a finger nail or a coin, unfortunately, the particles do not come off in a continuous sheet but in bits and pieces that tend to cling to the person or the persons clothing. In order to avoid the soiling problems created with removable particles I provide a collection mat 33 which is shown in a folded condition in pocket 27 in FIG. 2 and in the unfolded condition with a lottery ticket 40 located therein in FIG. 5. Located on lottery ticket 40 is a region with a particle covering material that a user removes by scraping the particles off the lottery ticket. Collection mat 33 comprises a sheet of colored polyethylene that has sufficient plastizer in it to provide a flexible, foldable sheet of material. It has been discovered that the use of a sheet of polymer plastic material has a natural affinity for the type of removable particles placed on lottery tickets or the like. That is, if one places the lottery ticket 40 on collection mat 33, as shown in FIG. 5, the user can scrape particles off region 41 with tool 30. As the particles are scraped off the lottery ticket and on to the collection mat 33 they cling to the mat thus eliminating the soiling mess usually created by the particles adhering to the person or the person's clothing. While it is not fully understood why the particles adhere to collection mat 33 it is believed that static electricity attracts the particles to the mat to provide a convenient collection region that can be wiped clean with a discardable tissue after the lottery ticket covering material has been removed. Although use of materials in mat 33 that provides a natural clinging or attraction for the particles is preferred other type materials which could collect the particles could also be used. For example, throwaway tissues could be carried in pocket 27 to permit the user to throw away the used tissue with the particles scraped from the lottery ticket.

When the user has finished scraping the covering material from the lottery ticket and cleaned off mat 33 the user folds mat 33 along dotted lines 46 and 47 to produce a folded mat that can be inserted in pocket 27. Since collection mat 33 is made from a flexible material. I fold matt 33 along lines 46 and 47 and insert a strip of rigid cardboard or the like 44 that can be inserted before mat 33 is folded to provide the necessary stiffness to insert collection mat 33 into the sandwich like pocket 27 formed by panel 25 and panel 21.

I claim:

1. A pocket lottery kit for holding a lottery ticket with removable particle covering material thereon and removable particles scraped from a lottery ticket comprising:

a first panel of heat sealable material having peripheral edges and a second panel of heat sealable material, said first panel having a first inside sheet of heat sealable material having peripheral edges with the peripheral edges of said first inside sheet heat sealed to said first panel along the peripheral edges of said first panel to provide a pocket for receiving a lottery ticket, said second panel having peripheral edges and a second inside sheet of heat sealable material having peripheral edges with said second inside sheet heat sealed to said peripheral edges of said second panel to provide a pocket for a collection mat;

a flexible hinge connecting said first panel to said second panel, said flexible hinge including a pocket for frictionally holding a scraping tool;

a collection mat of a foldable flexible polymer plastic material for placing a lottery ticket on when the user scrapes removable particles off the lottery ticket, said foldable polymer plastic made from a material to produce a clinging action for removable particles removed from the lottery ticket to eliminate the soiling mess of particles adhering to a person or a persons clothing; and a scrapping tool for removing particle covering material from a lottery ticket by scraping the lottery tool over the removable particles, said scraping tool having a scraping blade with a straight edge to permit a user to scrape removable particles from a lottery ticket onto said foldable polymer plastic material so that when the user has scraped the removable particles onto said collection mat the user can fold and place said collection mat with the removed particles clinging to said collection mat in the pocket lottery kit thereby preventing the removable particles from falling into the user's pocket as the pocket lottery kit is carried about.

2. The pocket lottery kit of claim 1 wherein said first panel and said second panels include stiffeners to hold said first panel and said second panel in a flat condition.

3. The pocket lottery kit of claim 2 wherein said collection mat is made of polyethylene.

4. The pocket lottery kit of claim 3 wherein said collection mat is is larger than a lottery ticket to have particles removed so that a lottery ticket can be placed on said mat with the collection mat extending beyond the lottery ticket.

5. A pocket size lottery kit for holding a lottery ticket having removable particles and a tool for use with the lottery ticket comprising:

a pair of panels that are foldable connected to each other to provide a lottery kit that can be laid flat in an opened condition or folded in a closed condition;

a pocket for holding a collection mat;

a transparent sheet located on one of said panels to coact with one of said panels to provide a pocket with a transparent face to permit the user to observe the lottery number on a lottery ticket located in said pocket;

a foldable collection mat for placing on a surface so that a lottery ticket with removable particles can be placed thereon, said collection mat having an area for collecting removable particles with the area of the collection mat larger than the lottery ticket a tool for use with a lottery ticket said tool for scraping removable particles from a lottery ticket onto said collection mat while the user scrapes the removable particles onto said collection mat so that the removable particles from said lottery ticket can be folded into said collection mat to permit the user to store said collection mat with said removable particles in said lottery kit; and a compartment for holding said tool in said lottery kit when the lottery kit is in an open or closed condition.

6. The lottery kit of claim 5 wherein said pair of panels are made from a flexible polymer plastic material and said lottery kit includes stiffeners located adjacent said panels to hold said panels in a flat condition.

7. The lottery kit of claim 5 wherein said lottery kit includes a scraping tool having a straight blade end for scraping removable particles from a lottery ticket.

8. The lottery kit of claim 7 wherein said lottery kit includes a spine having ridges and groove therein to provide a hinge for opening and closing said lottery kit.

9. The lottery kit of claim 8 wherein said lottery kit tool comprises an elongated cylindrical member made from a polymer plastic and having a wedge shaped head on said elongated cylindrical member.

* * * * *